US007985038B2

(12) United States Patent
Kwon et al.

(10) Patent No.: US 7,985,038 B2
(45) Date of Patent: Jul. 26, 2011

(54) EARTH ANCHOR BRACKET HAVING SAW-TOOTHED AND CURVED PART

(75) Inventors: Jung-Am Kwon, Seoul (KR); Il-Jun Sohn, Seoul (KR); Young-Gyu An, Busan (KR); Man-Ki Lee, Gimhae-si (KR); Byung-Kyu Yoo, Pyeongtaek-si (KR); Kyu-Ho Choi, Busan (KR); Soon-Bong Baek, Incheon (KR); Jun-Hyun Dokgo, Daejeon (KR)

(73) Assignee: New Technical Industry Co. Ltd., Incheon (KR)

( * ) Notice: Subject to any disclaimer, the term of this patent is extended or adjusted under 35 U.S.C. 154(b) by 0 days.

(21) Appl. No.: 12/521,515

(22) PCT Filed: Oct. 4, 2007

(86) PCT No.: PCT/KR2007/004845

§ 371 (c)(1),
(2), (4) Date: Oct. 19, 2009

(87) PCT Pub. No.: WO2008/082060

PCT Pub. Date: Jul. 10, 2008

(65) Prior Publication Data

US 2010/0322718 A1 Dec. 23, 2010

(30) Foreign Application Priority Data

Dec. 28, 2006 (KR) ..... 10-2006-0136256

(51) Int. Cl.
*E02D 5/80* (2006.01)
*E02D 29/02* (2006.01)

(52) U.S. Cl. ..... 405/262; 405/284; 405/285; 405/286

(58) Field of Classification Search ..... 405/259.1, 405/262, 284, 285, 286
See application file for complete search history.

(56) References Cited

U.S. PATENT DOCUMENTS

| | | | | |
|---|---|---|---|---|
| 3,541,798 | A * | 11/1970 | Schnabel, Jr. | 405/262 |
| RE28,977 | E * | 9/1976 | Mason | 405/262 |
| 4,090,364 | A | 5/1978 | Müller | 61/39 |
| 4,690,588 | A * | 9/1987 | Berger | 405/262 |
| 4,725,168 | A * | 2/1988 | Fagundes | 405/262 |
| 4,911,582 | A * | 3/1990 | Peirce et al. | 405/262 |
| 6,652,196 | B1 * | 11/2003 | Rainey | 405/262 |
| 6,893,191 | B2 * | 5/2005 | Weyant et al. | 405/284 |

FOREIGN PATENT DOCUMENTS

JP H03-059215 3/1991

(Continued)

*Primary Examiner* — Frederick L Lagman
(74) *Attorney, Agent, or Firm* — Harness, Dickey & Pierce, P.L.C.; Anthony G. Fussner; Kisuk Lee

(57) ABSTRACT

The present invention provides an earth anchor bracket supported by a girder coupled to a side surface of an earth wall to fix a free length of an anchor body inserted into a boring hole formed at the earth wall according to an earth anchor method. The earth anchor bracket of the present invention includes two side plates each including a curved portion including saw-teeth and facing each other; a coupling material coupling and fixing the two side plates; and a pressure bearing means, supported by the two side plates and including obstacle protrusions engaged with the saw-teeth of the two side plates and a through portion withdrawing the free length of the anchor body.

15 Claims, 12 Drawing Sheets

FOREIGN PATENT DOCUMENTS

| | | |
|---|---|---|
| JP | H06-322759 | 11/1994 |
| JP | H07-243213 | 9/1995 |
| JP | H09-078577 | 3/1997 |
| JP | H09-189113 | 7/1997 |
| KR | 10-2002-0043507 | 6/2002 |
| KR | 20-0372358 | 1/2005 |
| KR | 20-0421331 | 7/2006 |

* cited by examiner

PRIOR ART

PRIOR ART

PRIOR ART

PRIOR ART

EARTH ANCHOR BRACKET HAVING SAW-TOOTHED AND CURVED PART

CROSS REFERENCE TO RELATED APPLICATIONS

This is a national phase application of PCT International Application No. PCT/KR2007/004845 filed Oct. 4, 2007 (Publication No. WO 2008/082060), which claims priority to Korean Application No. 10-2006-0136256 filed Dec. 28, 2006. The disclosures of the above applications are incorporated herein by reference.

TECHNICAL FIELD

The present invention relates to an earth anchor bracket supporting an earth anchor which is inserted and fixed into a ground to prevent a soft ground collapsing, and more particularly, to an earth anchor bracket in which saw-teeth are formed at a curved portion of a side plate to prevent a pressure bearing plate moving.

BACKGROUND ART

Generally, when a steep excavation hole is formed in a digging or foundation work at a civil engineering and construction field, to prevent an earth wall falling down toward the excavation hole, an earth anchor method is widely used. The earth anchor method is explained as follows.

As shown in FIG. 1, big stakes such as H-beams are driven into a ground and a designated ground is excavated, and then earth plates are inserted between the big stakes, and thus an earth wall 1 is formed.

Subsequently, boring is performed through the earth wall 1 at a predetermined slanted angle, then an anchor body 3 is driven into the boring portion 2, then grouting is performed for a fixed anchor length Lb, and thus the anchor body 3 is fixed. Generally, the anchor body 3 is divided into a free length La and the fixed anchor length Lb with respect to a portion at which a virtual collapse line (which is represented by a dashed line in FIG. 1) meets the boring portion, and the virtual collapse line is set by a design standard according to a soil between an edge of a bottom surface 6 of the excavation hole and the ground. A first grouting is generally performed for the fixed anchor length Lb.

When curing for the grouting is completed, a tension force is applied to the free length La of the anchor body 3 and the anchor body 3 is fixed into a bracket 10 which is installed at a girder 4 of the earth wall 1. To do this, the free length La of the anchor body 3 is passed through a through portion formed at the bracket 10 and then is fixed using a cone 5 having a diameter more than the through portion.

After the anchor body 3 is fixed into the bracket 10, a second grouting is performed for a remaining portion of the boring portion 2, and thus construction is completed. Accordingly, a tension force of the anchor body 3 counters with an earth pressure and supports the earth wall 1.

The present invention relates to a bracket applying the tension force to the free length La of the anchor body 3 and fixing the anchor body 3 in the earth anchor method.

FIG. 2 is a perspective view illustrating one example of a bracket 10 widely used in the prior art. The bracket 10 includes two side plates 11 each having about triangular shape, and a pressure bearing plate 12 which is installed on the same inclined sides of the two side plates 11 and couples the two side plates 11 and includes a through portion 12*a*, through which the anchor body 3 is withdrawn, at a center portion of the pressure bearing plate 12.

However, for the bracket 10, because the tension force of the anchor body 3 is distributed through the pressure bearing plate 12 and the both side plates 11, a case frequently occurs in construction that the pressure bearing plate 12 warps and the side plates 11 are deformed.

Further, as shown in FIG. 1, because the bracket 10 is supported by the girder 4, to fix the bracket 10, it is necessary that the side plates of the bracket 10 are welded to the girder 4. Accordingly, it takes much time to install and disjoint the bracket 10, and due to the welding, damages to the girder 4 may be unavoidable.

Recently, to resolve these problems, new type of brackets have been put on the market. For example, FIGS. 3 and 4 are perspective and exploded perspective views, respectively, of a bracket 50 described in Korean Issued Patent No. 441619.

The bracket 50 includes a main supporting material 20, an auxiliary supporting material 40, a guide material 30 fixed between the main supporting material 20 and the auxiliary material 40.

The main supporting material 20 includes two side plates 21, a pressure bearing plate 23 welded to upper portions of the same inclined sides 21*a* of the both side plates 21 and having a through portion 24, and base plates 22*a* and 22*b* spaced apart from each other and fixed to lower portions of the side plates 21.

The auxiliary supporting material 40 has a bent shape at a predetermined angle at a center of the auxiliary supporting material 40 and is fixed between the both side plates 21 of the main supporting material 20. The guide material 30 has about cylindrical shape, and one end of the guide material 30 is fixed to the pressure bearing plate 23 of the main supporting material and the other end of the guide material 30 is fixed to the auxiliary supporting material 40.

Because the auxiliary supporting material 40 and the guide material 30 distributes a tension force of an anchor body applied to the main supporting material 20, the bracket 50 endures a tension force more than the bracket described in FIG. 2. As shown in FIG. 5, even though a real tension direction of the anchor body 3 is not equal to a reference tension angle of the bracket 50, a free length of the anchor body 3 is withdrawn through the guide material 30, and it can be prevented to some extent to prevent the anchor body interfering with the through portion 24 and the girder 4.

However, as shown in FIG. 5, when the real tension direction of the anchor body 3 is not equal to the reference tension angle of the bracket 50, it is unavoidable that the anchor body 3 is severely bent and withdrawn through the guide material 30 and the through portion.

When the anchor body 3 is bent, a force in a different direction from the tension direction of the anchor body 3 is applied, and as a result, it is inevitable that the tension force applied to the anchor body 3 is distributed. Accordingly, to apply a tension force according to a design standard to the anchor body 3, a tension force more than that in a normal situation should be applied in consideration of distribution of a tension force. This means that the bracket 50 should have a more supporting force, and works as a limitation to losing weight and minimizing size of the bracket 50.

Recently, to resolve these problems, an earth anchor bracket has been suggested in which an arch-shaped curved portions are formed at inclined sides of both side plates and a pressure bearing plate is moved along the curved portions.

When the curved portion is formed in the earth anchor bracket, because the pressure bearing plate can be moved according to an installation angle of the anchor body, even though the anchor body is not bent, it is possible to maintain tension direction of the anchor body perpendicular to the pressure bearing plate.

To obtain this effect, a boring portion formed at a earth wall to insert the anchor body is bored exactly at a center of curvature of the arch-shaped curved portion of the earth anchor bracket.

However, in a real construction field, a case occurs much that the boring portion is deviated from a reference position. Accordingly, even though the pressure bearing plate is moved along the arch-shaped curved portion, it is difficult to maintain the tension direction of the anchor body perpendicular to the pressure bearing plate.

When the tension direction of the anchor body is not maintained perpendicularly to the pressure bearing plate, because a horizontal force as well as a perpendicular force is applied to the pressure bearing plate, the ground plate is moved along the curved portion of the earth anchor bracket and, for the moving, deformation of the pressure bearing plate occurs.

DISCLOSURE OF INVENTION

Technical Problem

To achieve these and other advantages and in accordance with the above purpose, the present invention has objects as follows.

Firstly, an object of the present invention is to appropriately cope with even case using one bracket that a tension direction of an anchor body is different from a reference tension angle.

Secondly, another object of the present invention is to provide a bracket a supporting force of which is more improved than the bracket in the prior art.

Thirdly, another object of the present invention is to cope with even case that an interval between girders supporting a bracket varies and to easily install the bracket to the girders.

Fourthly, another object of the present invention is to provide an earth anchor bracket which can prevent a pressure bearing plate moving beyond a designated position.

Technical Solution

To achieve these and other advantages and in accordance with the purpose of embodiments of the invention, as embodied and broadly described, the present invention provides an earth anchor bracket, the earth anchor bracket supported by a girder coupled to a side surface of an earth wall to fix a free length of an anchor body inserted into a boring hole formed at the earth wall according to an earth anchor method, the earth anchor bracket comprising: two side plates each including a curved portion including saw-teeth and facing each other; a coupling material coupling and fixing the two side plates; and a pressure bearing means supported by the two side plates and including obstacle protrusions engaged with the saw-teeth of the two side plates and a through portion withdrawing the free length of the anchor body.

The pressure bearing means includes: a cylinder material including the through portion, wherein a lower end of the cylinder material is put between the two side plates; and rack portions outside the cylinder material and placed on the curved portions of the two side plates, wherein the rack portions include the obstacle protrusions engaged with the saw-teeth at lower portions of the rack portions.

A supporting material supporting the lower end of the cylinder material is coupled to the inner surfaces of the side plates, wherein an upper surface of the supporting material has the same curvature as the curved portion.

An auxiliary supporting material coupling a lower portion of the supporting material to the inner surfaces of the side plates to increase pressure resisting ability is installed.

Hook portions are formed at the lower end of the cylinder material to hang the cylinder material on the supporting material coupled to the inner surfaces of the side plates.

The pressure bearing means includes: a pressure bearing plate including a through portion and placed on the curved portions of the two side plates, wherein the obstacle protrusions are formed at both ends of the pressure bearing plate; a cylinder material coupled to a lower portion of the pressure bearing plate and communicated with the through portion; an auxiliary pressure bearing plate coupled to side of a lower end of the cylinder material; and a supporting material coupled to inner surfaces of the two side plates to support both ends of the auxiliary pressure bearing plate, wherein an upper surface of the supporting material has the same curvature as the curved portion.

A reinforcing material includes a first plate coupled to an outside surface of the side plate and a second plate bent vertically from an upper end of the first plate, wherein the upper end of the first plate and the second plate have the same curvature as the curved portion of the side plate.

Advantageous Effects

According to the present invention, because the curved portion including the saw-teeth is formed at the side plate of the earth anchor bracket, even though a position of a boring portion to insert the anchor body is deviated somewhat from a right position, the pressure bearing means bearing the tension force of the anchor body can be prevented moving.

Further, because the pressure resisting ability is further improved than that of the prior art, lightening and miniaturizing the earth anchor can be sought compared to the prior art with respect to the same tension force.

EXPLANATION OF MAJOR PARTS IN THE FIGURES

Figure 1:
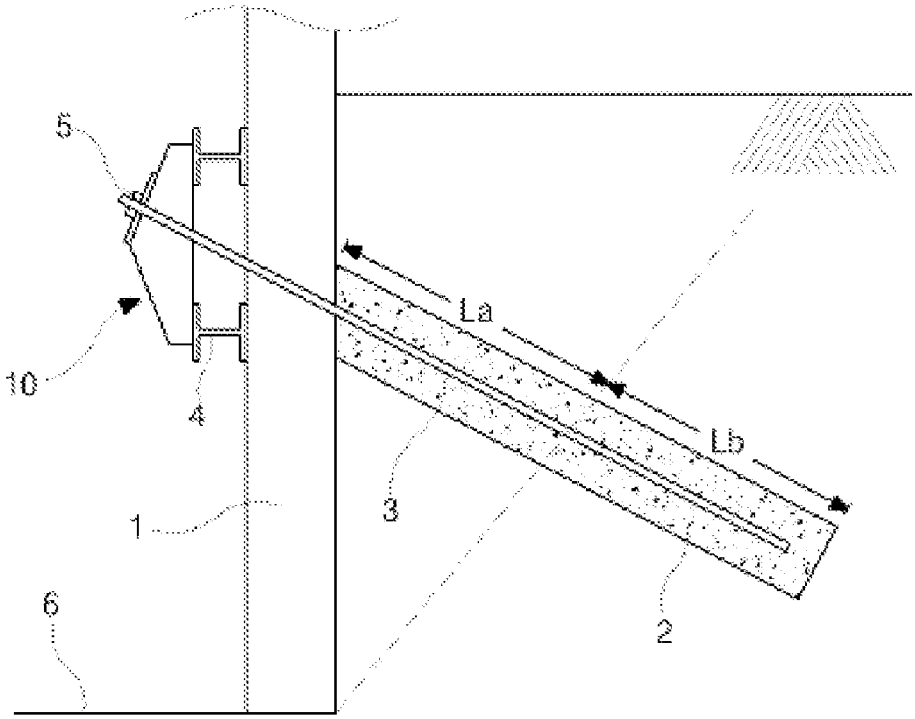
FIG. 1 PRIOR ART
FIG. 1 is a schematic view illustrating an earth anchor method.
Figure 2:
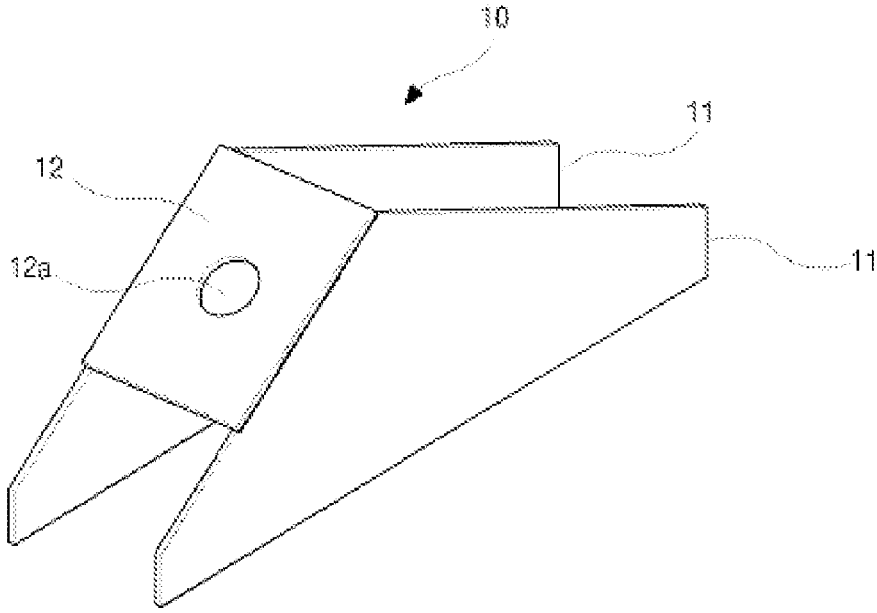
FIG. 2 is a perspective view of one type of an earth anchor bracket according to the prior art.
Figure 3:
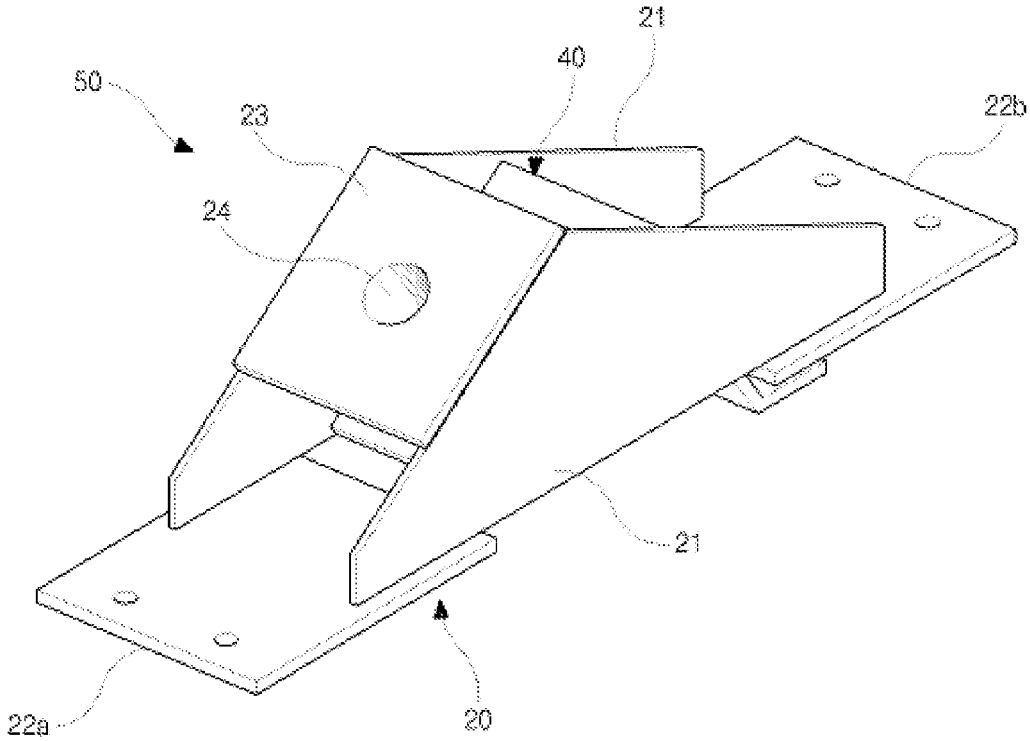
FIGS. 3 and 4 are perspective views of different types of earth anchor brackets according to the prior art.
Figure 4:
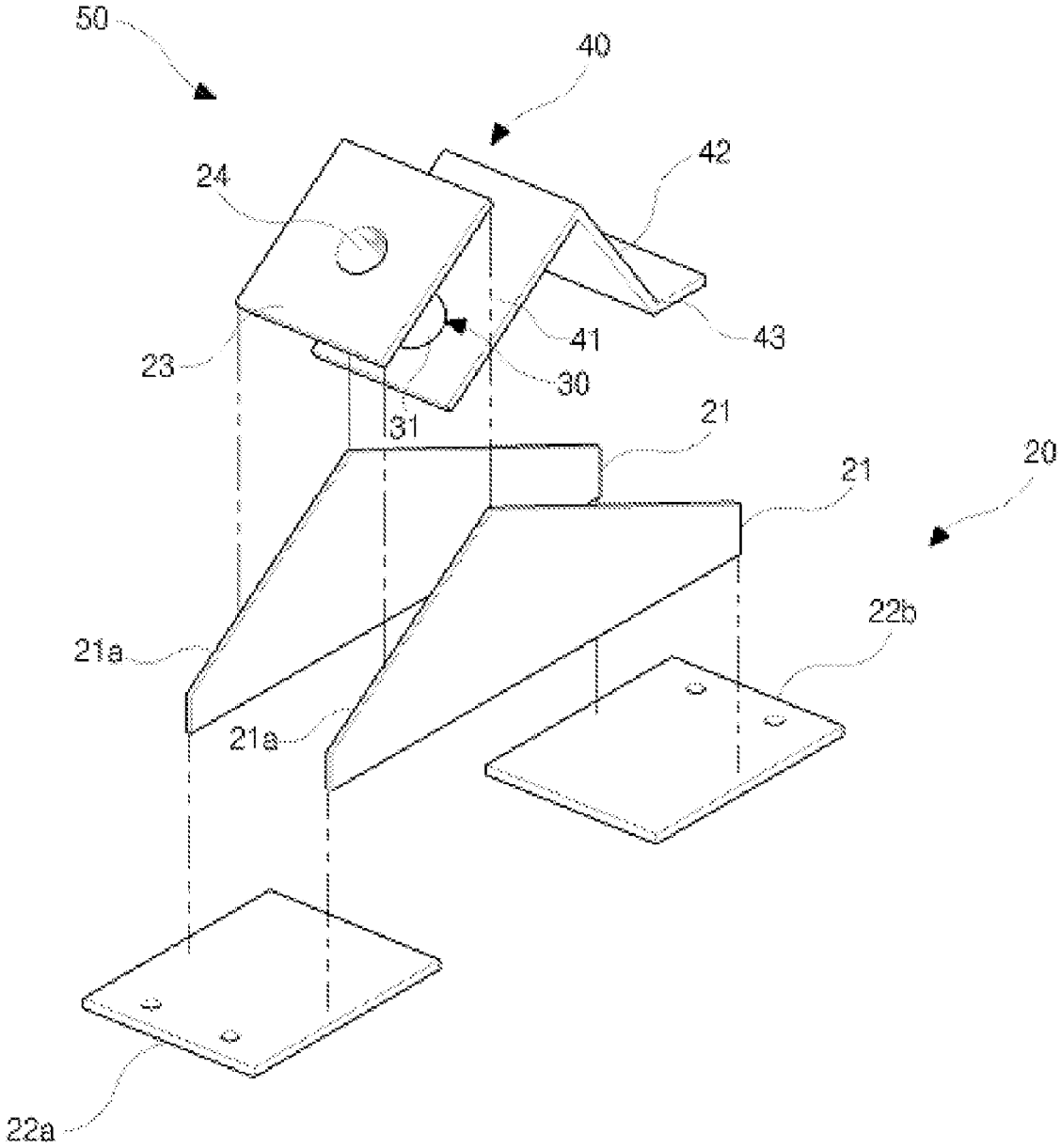
Figure 5:
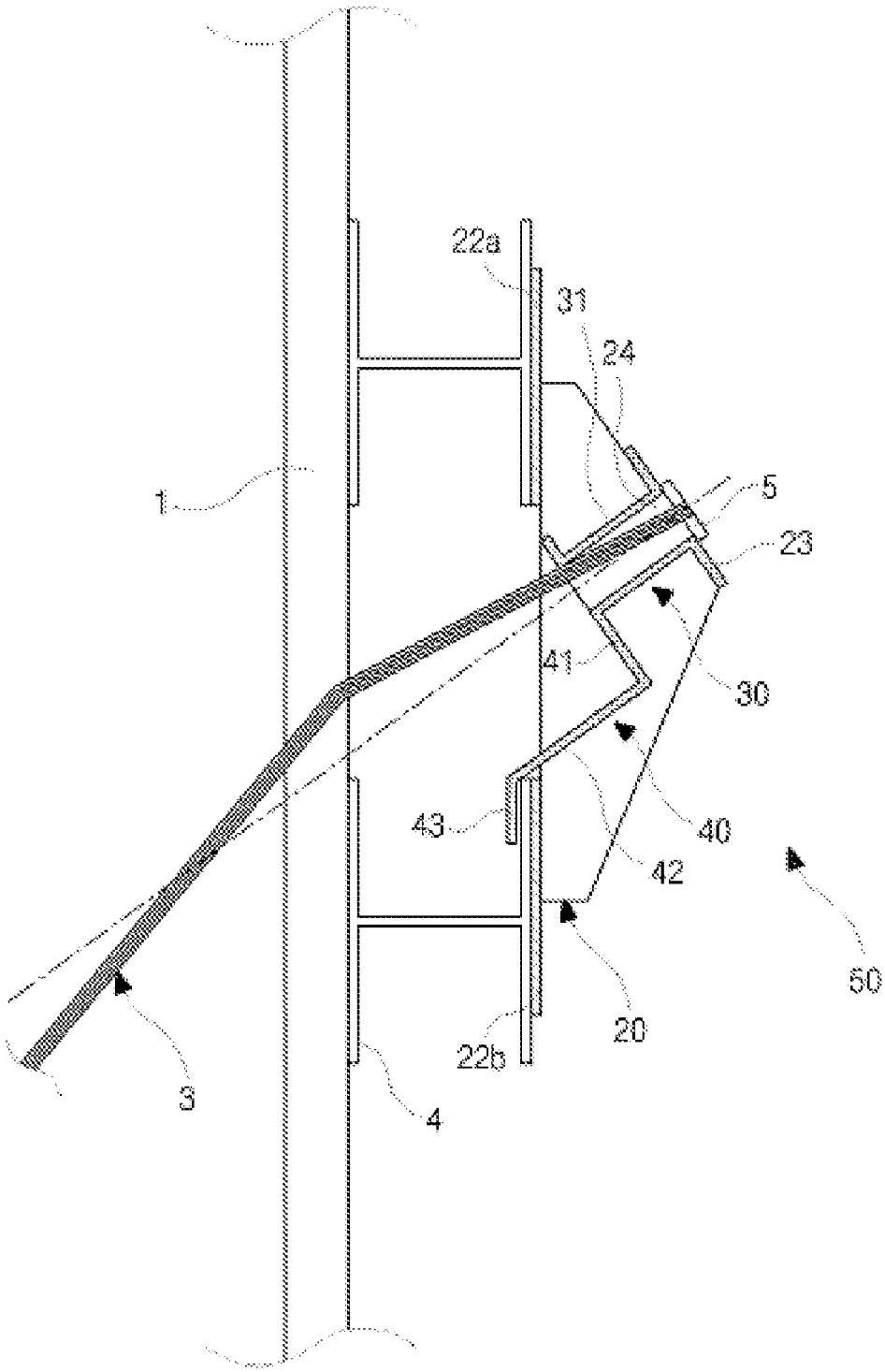
FIG. 5 is a cross-sectional view illustrating installation of the bracket shown in FIG. 3.

100: earth anchor bracket
110: side plate
111, 112: first and second inclined sides
114: curved portion
115: saw-teeth
116: coupling hole
120: coupling material
130: pressure bearing plate
132: through portion
134: obstacle protrusion
140: cylinder material
142: rack portion
144: obstacle protrusion
146: hook portion
150: supporting material
160*a*, 160*b*: first and second base plates
162: hook end
170: fixing material
172: coupling hole
180: bolt
182: nut
190: reinforcing material

BEST MODE FOR CARRYING OUT THE INVENTION

First Embodiment

Figure 6:
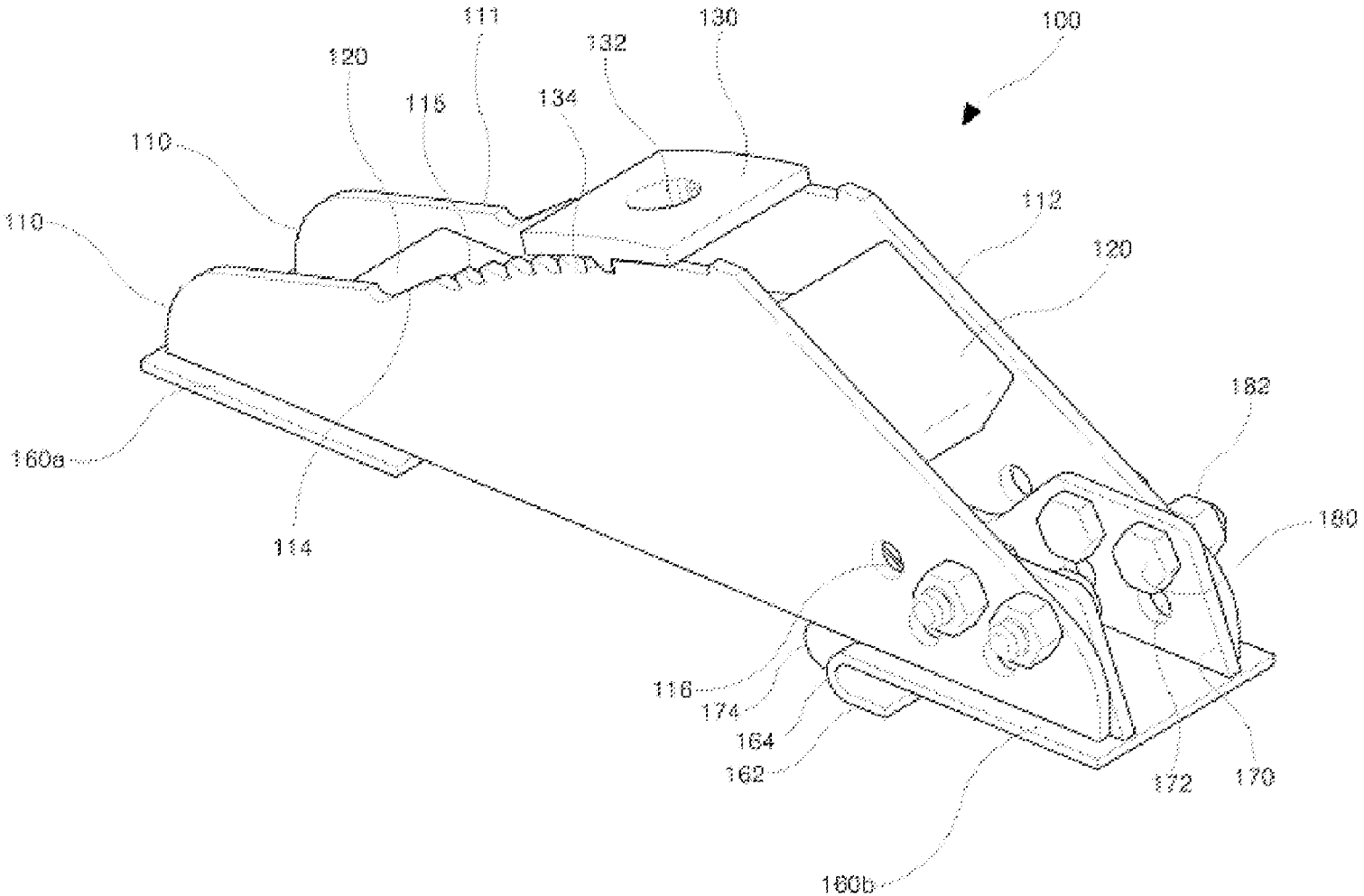
FIG. 6 is a perspective view of an earth anchor bracket according to a first embodiment of the present invention.

FIG. 6 is a perspective view of an earth anchor bracket 100 according to a first embodiment of the present invention, and 7 is a side view illustrating an installation of the earth anchor bracket 100 according to the first embodiment of the present invention.

The earth anchor bracket 100 according to the first embodiment of the present invention includes two side plates 110 installed in parallel with each other, and a pressure bearing plate 130 installed on upper portions of the both side plates 110 to support tension force applied to a free length of an anchor body.

Because a parallel state of the both side plates 110 should be maintained when a tension force is applied, a coupling material 120 is installed between the both side plates 110 to firmly couple the both side plates 110.

The side plates 110 have about triangular shape. An arch-shaped curved portion 114 is formed at a first inclined side 111 coupled to the pressure bearing plate 130, and a second inclined side 112 is straight or curved.

The pressure bearing plate 130 includes a through portion 132, through which a free length of the anchor body is withdrawn, at a center portion of the pressure bearing plate 130. Because the pressure bearing plate 130 is coupled to the curved portion 114 of the first inclined side of the side plate 110, the pressure bearing plate 130 has the same curvature as the curved portion 114.

In the present invention, to prevent the pressure bearing plate 130 moving, saw-teeth are formed at the arch-shaped curved portion 114 of the first inclined side 111 of the side plate, and obstacle protrusions 134 engaged with the saw-teeth 115 are projected from and formed at a lower portion of the pressure bearing plate 130.

Accordingly, when the obstacle protrusion 134 of the pressure bearing plate 130 is engaged with the saw-tooth 115 of the first inclined side 111, even though the tension direction of the anchor body is deviated somewhat from a reference tension angle, the pressure bearing plate 130 is prevented being moved.

It is not needed to form the whole first inclined side 111 of each side plate 110 as the curved portion 114. However, it is desirable that the portion coupled to the pressure bearing plate 130 is treated to have a predetermined curvature.

Accordingly, it is desirable that a virtual line connecting upper ends of the saw-teeth 115 of the curved portion 114 of the first inclined side 111 is located at the same circumference.

A shape of the saw-tooth is not limited to a specific shape. However, the shape of the saw-tooth should have a shape engaged with the obstacle protrusion 134, and at least, it is certain that the shape of the saw-tooth has a strength to an extent to endure the tension force of the anchor body in a state that the saw-tooth is engaged with the obstacle protrusion 134 of the pressure bearing plate 130.

Figure 7:
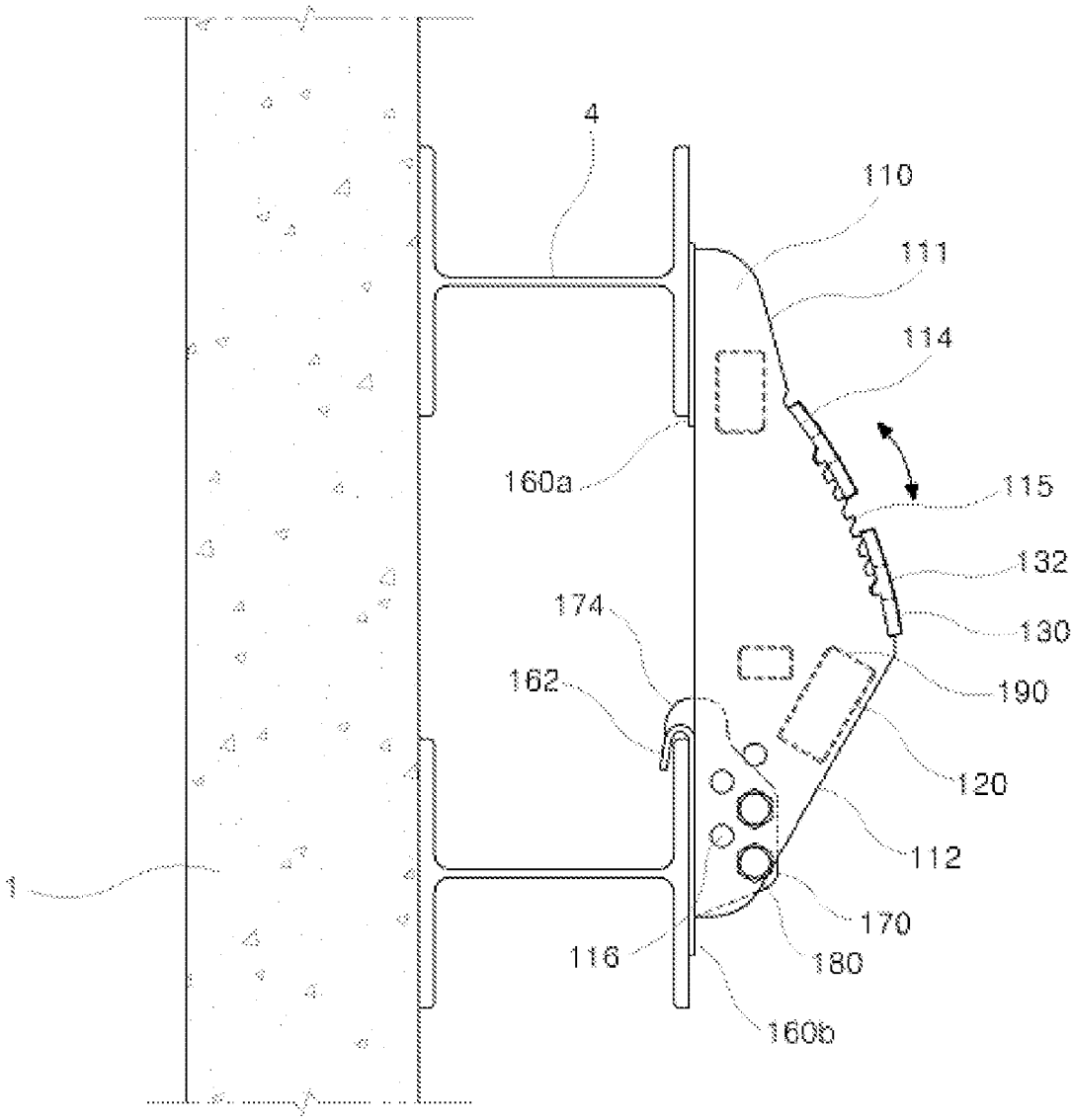
FIG. 7 is a side view illustrating installation of an earth anchor bracket according to the first embodiment of the present invention.

Further, as shown in FIG. 7, when the pressure bearing plate, 130 is placed at the curved portions 114 of the side plates in a state that the earth anchor bracket 100 is placed at the girder 4, it is desirable that the pressure bearing plate 130 is not detached even though a worker does not fix with hands.

To do this, it is desirable that an upper surface portion of each saw-tooth 115 receiving a pressure of the obstacle protrusion 134 is inclined at a predetermined angle with respect to a horizontal plane, and it is desirable that the upper surface portion of each saw-tooth 115 is formed in a diameter direction with respect to a center of curvature of the curved portion 114 of the side plate.

Accordingly, when the earth anchor bracket 100 of the present invention is used, it is possible to make a position of the pressure bearing plate 130 in moving the pressure bearing plate 130 along the curved portion 114 of the side plate according to tension angle of the anchor body, and because it is not needed to fix the pressure bearing plate 130 with hands before the tension force is applied, installation work can be simplified and work stability can increase.

Further, because the saw-teeth 115 of the curved portion 114 function to make a position of the pressure bearing plate 130, it is desirable that intervals between the saw-teeth are uniform. In the embodiment of the present invention, the saw-tooth is spaced apart from adjacent saw-tooth by an angle of 2 or 3 degrees angle.

In the mean time, because the earth anchor bracket 100 is installed to the girders 4, which are vertically spaced apart from each other, such as general H-beams, to effectively distribute the tension force applied to the both side plates 110 through the girders 4, coupling first and second base plates 160*a* and 160*b*, which are spaced apart from each other, on the lower portions of the both side plates 110 and closely adhering the first and second base plates 160*a* and 160*b* to the girders 4, as shown in FIGS. 6 and 7 are preferred to directly contacting the lower portions of the both side plates 110 to the girders.

The first and second base plates 160*a* and 160*b* are spaced apart at a distance as long as an installation distance of the girders 4.

Further, in the earth anchor bracket 100 of the present invention, a hook end 162 which is capable of hanging on the girder 4 is formed at an upper portion of the first or second base plate 160*a* or 160*b*. Accordingly, because the earth anchor bracket 100 is simply installed by the hook end 162 hanging on the girder, it is not needed to weld the base plate to the girder.

In the embodiment of the present invention, the hook end 162 is formed by bending the upper portion of the second base plate 160*b* which is located at a lower level in a case of hanging on the girder 4. Alternatively, a hook end may be formed at the upper portion of the first base plate 160*a*.

However, in a case that the upper portion of the second base plate 160*b* is bent in a angulated shape, for example, '⊂' shape to form the hook end 162, when the tension force is applied, a problem occurs that an edge of the hook end 162 is broken.

To prevent this, in the present invention, a bent portion 164 for forming the hook end 162 is curved. Accordingly, because a pressure is prevented concentrating on a specific portion of the bent portion 164, breakage of the hook end 162 can be prevented.

Further, in the present invention, to further improve resistance ability to the tension force, a reinforcing means enclosing and supporting an outer surface of the bent portion 164 is further included and is explained hereinafter.

To fix the earth anchor bracket 100 according to the embodiment of the present invention to the girders 4, as shown in FIG. 7, the hook end 162 of the second base plate 160*b* hangs on the girder 4 and the first and second base plates 160*a* and 160*b* are closely adhered to the upper and lower girders 4, respectively.

Subsequently, the pressure bearing plate 130 is coupled to an appropriate position of the curved portion 114 of the first inclined side using the obstacle protrusion 134, and the free length of the anchor body is withdrawn through the through portion 132 of the pressure bearing plate 130 and then the tension force is applied.

At this time, when the boring portion formed at the earth wall is deviated from a right position, an installation angle of the pressure bearing plate 130 is not perpendicular to the tension direction of the anchor body, and thus a force in a tangent direction of the first inclined side 111 is applied to the pressure bearing plate 130. In the present invention, because of the saw-teeth 115 and obstacle protrusions 134, the pressure bearing plate 130 is prevented moving.

In the mean time, because it is difficult to cope with a case that the interval between the girders 4 is not constant when the interval between the first and second base plates 160*a* and 160*b* is fixed, it is desirable to adjust the interval between the first and second base plates 160*a* and 160*b*.

To do this, in the present invention, at least one of the first and second base plates 160*a* and 160*b* is detachable to the side plates 110 and is capable of having a variation of a coupling position.

As one example, as shown in FIGS. 6 and 7, the first base plate 160*a* is fixed to the both side plates 110 in a method such as welding, and the second base plate 160*b* including the hook end 162 is detachable from the side plates 110.

To do this, fixing materials 170 each including at least one coupling hole 172 are installed on one surface of the second base plate 160*b* to face each other, and a plurality of coupling holes 116 are formed in the vincity of an end portion of each side plate 110 where the second inclined side 112 is formed and at a predetermined distance along a length direction of the side plate 110.

Accordingly, with a bolt 180 passing through the coupling hole of the fixing material 170 and the coupling hole 116 of the side plate 110, it is possible to attach the second base plate 160*b* to the both side plates 110 and detach the second base plate 160*b* from the both side plates 110.

Differently from this, the first and second base plates 160*a* and 160 may be detachable from the side plates 110.

In a case that the interval between the first and second base plates 160*a* and 160*b* is needed to be adjusted according to the interval between the girders 4, the interval between the first and second base plates 160*a* and 160*b* can be adjusted in a method that the bolts 180 are disjoint and then rejoint through appropriate coupling holes 116.

Accordingly, even though various kinds of brackets having different lengths are not used, one earth anchor bracket 100 according to the embodiment of the present invention can cope with various installation intervals.

The coupling holes 116 of the side plate 110 may be in series. To minutely adjust the interval between the first and second base plates 160*a* and 160*b*, it is desirable that the coupling holes 116 are arranged in more than one line and has a zigzag shape in adjacent lines. In this case, it is desirable that the coupling holes 172 of the fixing material 170 are arranged in more than one line correspondingly to the coupling holes 116 of the side plate 110.

In the mean time, the fixing material 170 stands vertically to one surface of the second base plate 160*b* and is fixed with welding. The fixing material 170 includes a reinforcing portion 174, which puts around the bent portion 164 of the hook end 162 formed at the upper portion of the second base plate 160*b*, at one end portion of the fixing material 170.

The reinforcing portion 174 extends to the lower portion of the second base plate 160*b* to put around the curved surface of the bent portion 164. Further, a portion of the reinforcing portion 174 contacting the bent portion 164 has the same curvature as the bent portion 164.

Second Embodiment

Figure 8:
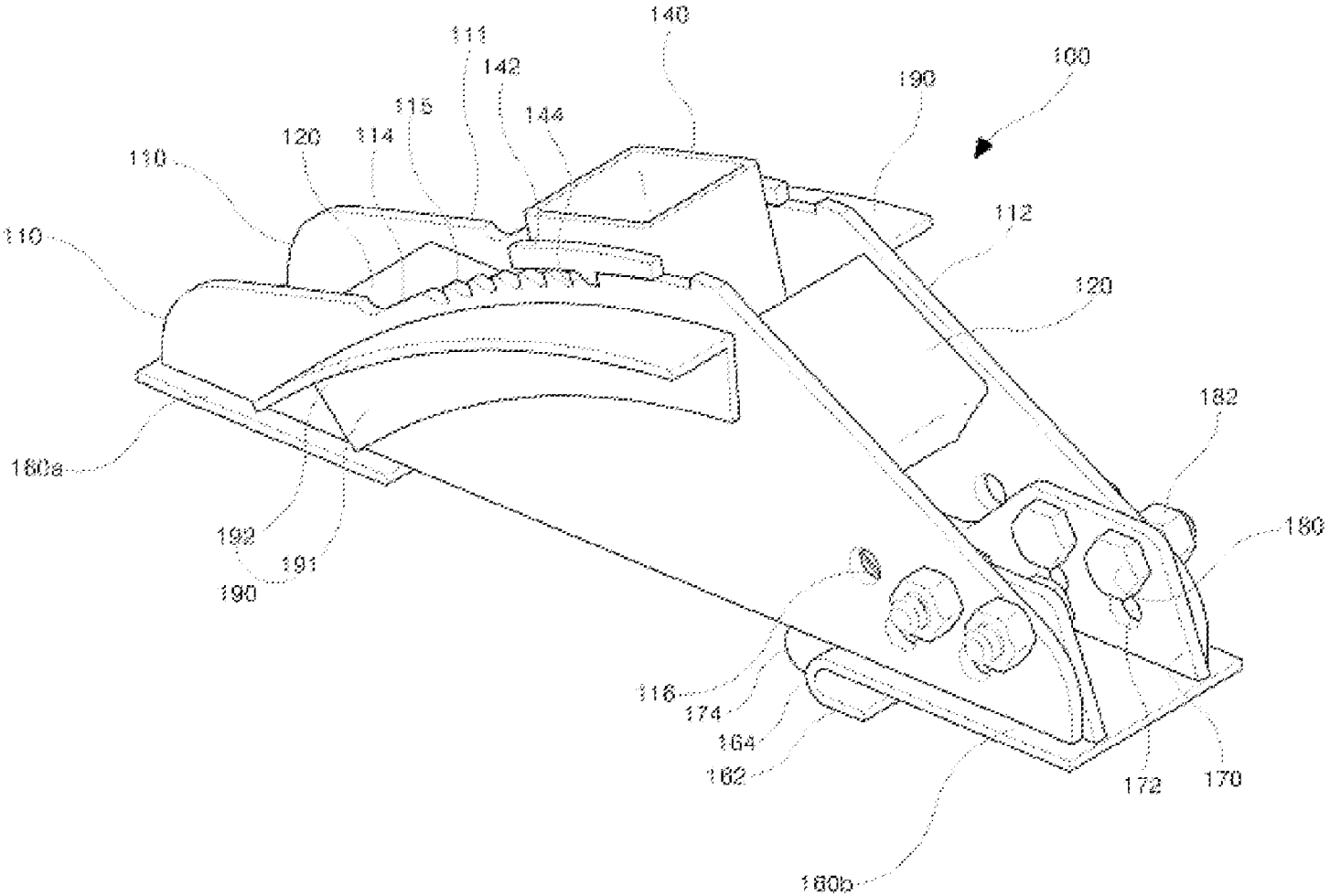
FIGS. 8 and 9 are perspective and exploded perspective views, respectively, of an earth anchor bracket according to a second embodiment of the present invention.
Figure 9:
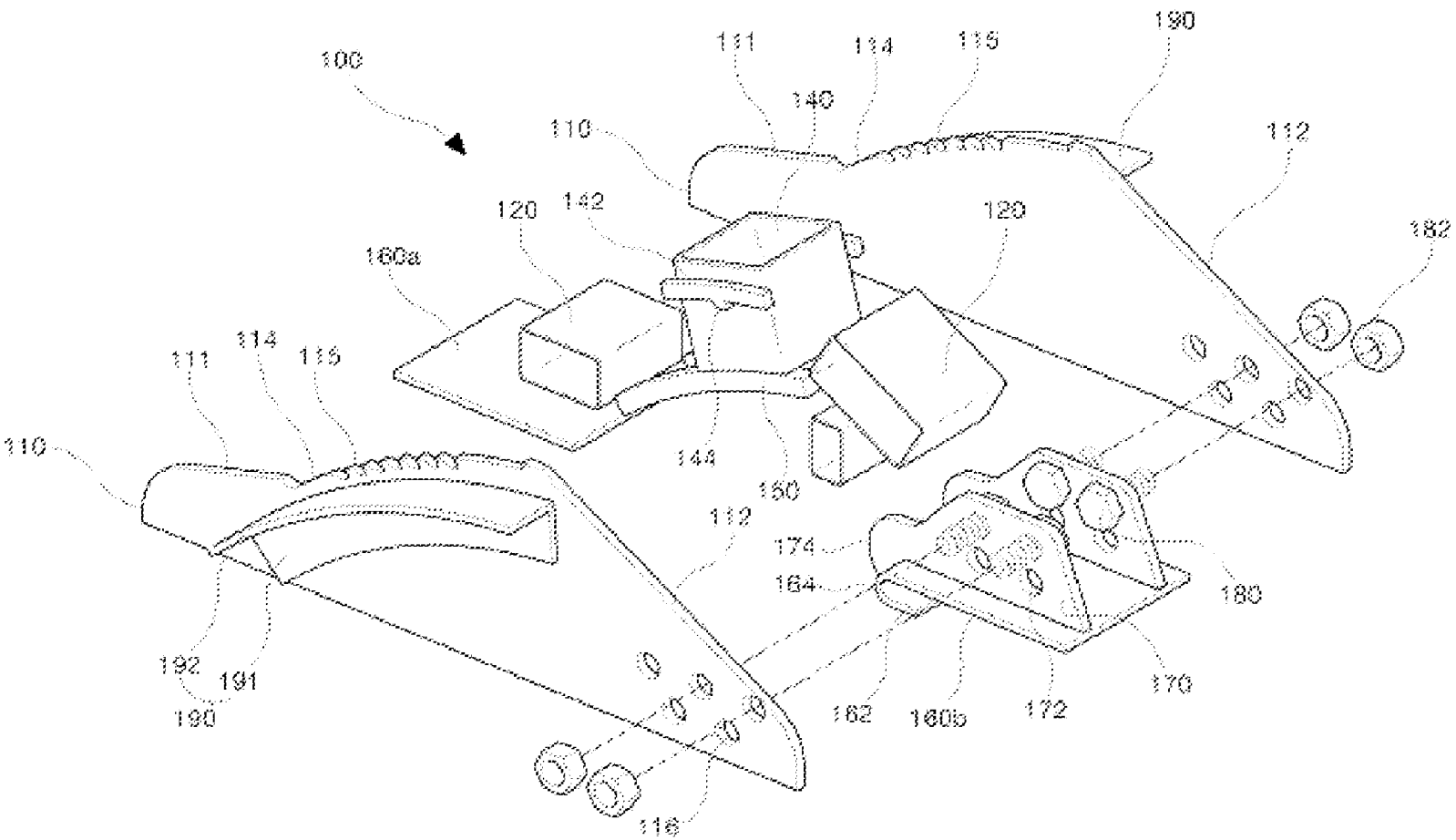

FIGS. 8 and 9 are perspective and exploded perspective views, respectively, of an earth anchor bracket 100 according to a second embodiment of the present invention.

The earth anchor bracket 100 according to the second embodiment of the present invention includes two side plates 110 facing each other and each including a curved portion 114 including saw-teeth 115, as similar to that of the first embodiment, and first and second base plates 160*a* and 160*b* located at both ends of bottom sides of the both side plates 110 and spaced apart from each other and be detachable from the both side plates 110.

In the second embodiment of the present invention, to improve pressure resisting ability, of the earth anchor bracket 100, reinforcing materials 190 are installed to outsides of the both side plates 110, and a cylinder material 140 is installed between the both side plates 110 to withdraw a free length of an anchor body.

Rack portions 142 placed on curved portions 114 of first inclined sides 111 of the both side plates 110 are protruded at outsides of the cylinder material 140, and obstacle protrusions 144 engaged with the saw-teeth 115 are formed at lower portions of the rack portions 142.

Because the rack portions 142 formed at the outsides of the cylinder material 140 are portions directly contacting the curved portions 114 of the first inclined sides 111 of the both side plates 110 when being installed, the rack portions 142 directly suffers the tension force applied to the anchor body, as similar to the pressure bearing plate 130 of the first embodiment.

Accordingly, it is desirable that lower surface of the rack portion 142 has the same curvature as the curved portion 114 in order to be arranged perpendicularly to the tension direction of the anchor body.

In the mean time, to further improve the ability of resist pressure of the earth anchor bracket 100, a supporting material 150, which supports a lower portion of the cylinder material 140, is formed at inside surfaces of the both side plates 110 facing each other.

Because an upper surface of the supporting material 150 supports the lower portion of the cylinder material 140 moving along the curved surface of the curved portion 114 of the side plate 110, it is desirable that the supporting material 150 has the same curvature as the curved portion 114.

The supporting material 150 may have a shape having two bands which are coupled to the respective side plates. The supporting material 150 may be a plate in one body having a through portion at a center portion of the supporting material 150 to withdraw the anchor body, and both sides of the plate may be coupled to the inner surfaces of the respective side plates 110.

Accordingly, the tension force of the anchor body applied to the rack portions 142 of the cylinder material 140 is distributed to the both side plates 110, and transmitted to the supporting material 150 and distributed to the both side plates 110. Accordingly, overall ability of the resist pressure is improved much.

At this time, when the supporting material 150 is supported by an auxiliary supporting material (not shown) an upper portion of which is fixed to the lower surface of the supporting material 150 and a lower portion of which is fixed to the inner surfaces of the side plates 110, the pressure resisting ability, is further improved.

In the mean time, in the second embodiment of the present invention, to improve the pressure resisting ability, the reinforcing material 190 is installed to the outside surface of each side plate 110.

The reinforcing material 190 includes a first plate 191 which is fixed to the outer surface of the side plate 110 with welding, and a second plate 192 which is perpendicularly bent outward from an upper end of the first plate 191. Accordingly, the reinforcing material 190 has '¬' shape. It is desirable that the second plate 192 has a curvature similar to that of the curved portion 114 of the first inclined side 111 of the side plate 110.

The reason of not attaching a band-shaped plate such as the first plate 191 but using the reinforcing material 190 having the above-described shape is that, in experimentation, the pressure resisting ability is more remarkably improved compared to a case that the band-shaped plate is attached.

It is analyzed that such the effect is because the first plate 191 of the reinforcing material 190 functions to bear a contractile force applied to the side plate 110 and the second plate 192 functions to prevent the side plate 110 warping outward.

In the mean time, because the cylinder material 140 is not fixed to the side plate 110, it should be performed to fix the side plates 110 to the girder and then put the cylinder material 140 between the both side plates 110 in a real installation.

Figure 10:
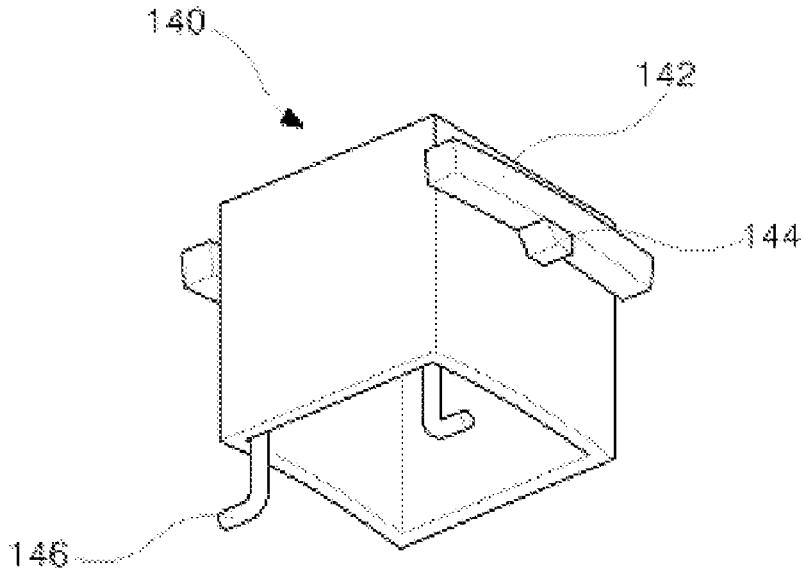
FIG. 10 is a bottom perspective view illustrating a state that a hook portion is formed at a cylinder material according to the second embodiment of the present invention.

However, when the cylinder material 140 is separated with the side plates 110, this may cause construction rate reduced. Accordingly, in the second embodiment of the present invention, as shown in FIG. 10, a method of coupling the cylinder material 140 to the side plates 110 by coupling hook portions 146 to the lower portion of the cylinder material 140 and hooking the supporting material 150 on the hook portions 146 is suggested.

Figure 11:
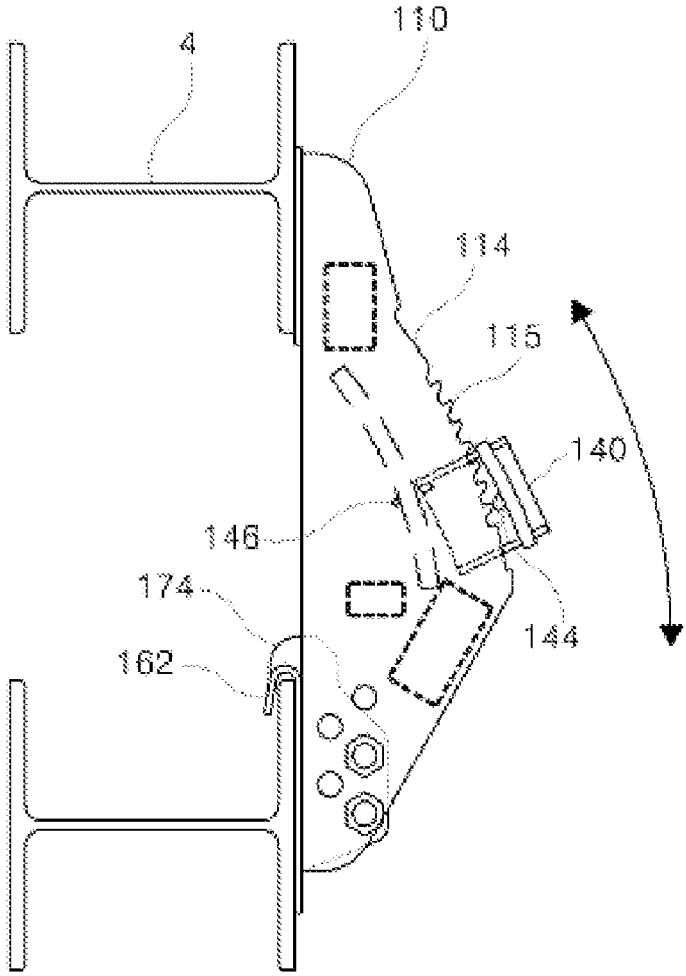
FIGS. 11 and 12 are views illustrating moving a cylinder material along curved portions of side plates using the cylinder material where a hook portion is formed.
Figure 12:
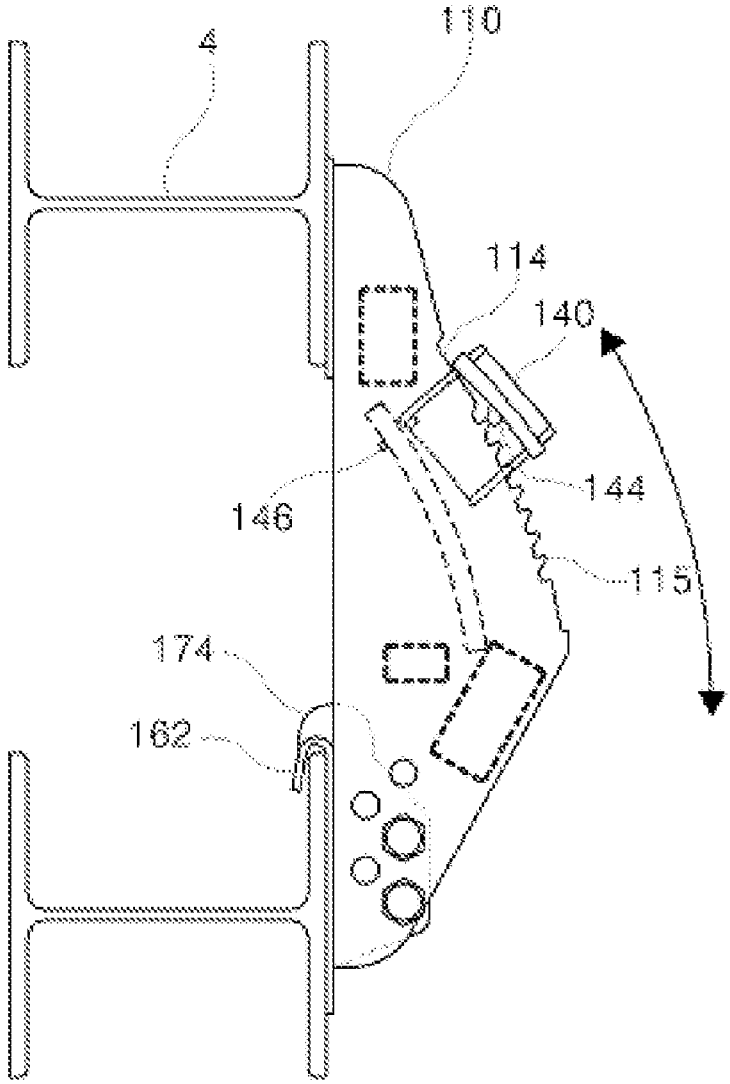

The reason of forming the hook portions 146 at one end of the cylinder material 140 is for the obstacle protrusions 144 to be lifted upside of the saw-teeth 115 when a position of the cylinder is changed. In other words, as shown in FIGS. 11 and 12, when other portion, in which the hook portions 146 do not exist, is lifted, the cylinder material 140 can be moved even though the hook portions 146 are caught on the supporting material 150.

Figure 13:
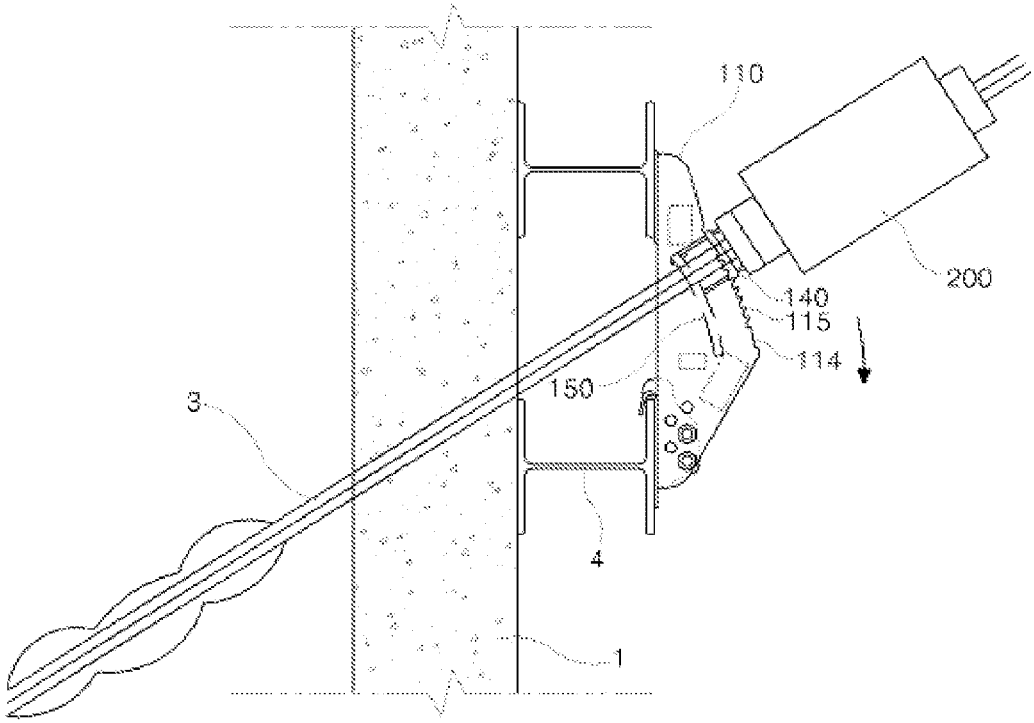
FIG. 13 is a view illustrating installation of an earth anchor bracket according to the second embodiment of the present invention.

FIG. 13 is a view illustrating a state that the earth anchor bracket 100 according to the second embodiment of the present invention is installed. FIG. 13 shows that the free length of the anchor body 3 withdrawn through the through portion of the cylinder material 140 is fixed by a tension device 200.

In similar to the first embodiment, in the earth anchor bracket 100 according to the second embodiment of the present invention, to adjust an interval between the first and second base plates 160*a* and 160*b*, a plurality of coupling holes 116 are formed at the side plates 110, and fixing materials 170 having at least one coupling hole 172 are coupled to one surface of the first or second base plate 160*a* or 160*b*, and then the side plates 110 are detachably coupled to the first or second base plate 160*a* or 160*b* using bolts 180.

Further, the hook end 162 is formed to hang on the girder 4 by bending the first or second base plate 160*a* or 160*b*, and to improve the pressure resisting ability of the hook end 162, the bent portion 164 may be curved. Further, to further improve the pressure resisting ability of the hook end 162, a reinforcing portion 174 at one end of the fixing material 170 and putting around the outside of the bent portion 164 may be formed.

In the mean time, in the above-mentioned, the rack portions 142 are coupled to the curved portions 114 of the side plates 110. Alternatively, the cylinder material 140 may have other shape.

Figure 14:
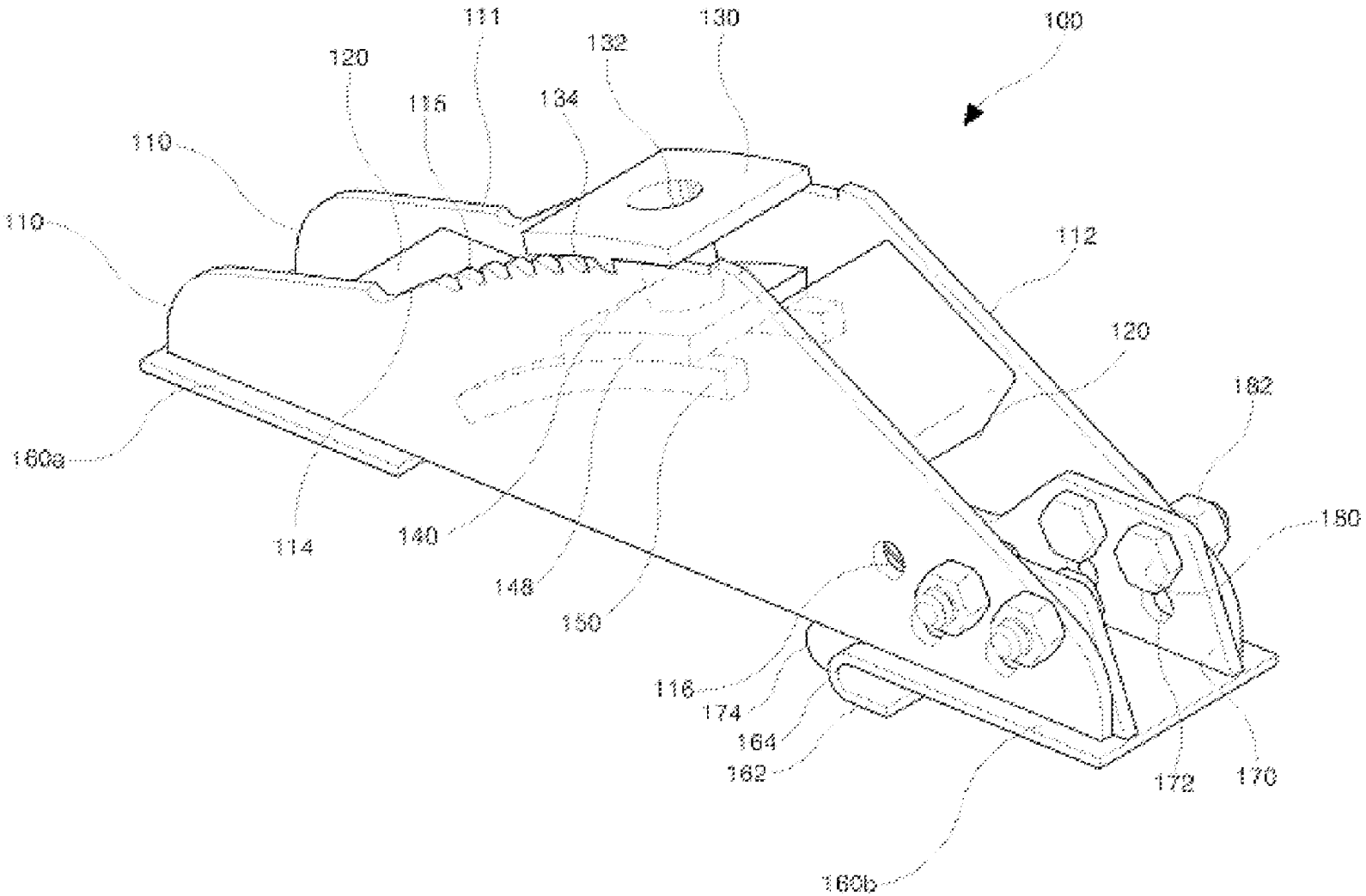
FIG. 14 is a perspective view of an earth anchor bracket where a pressure bearing plate is coupled to a cylinder material.

For example, as shown in FIG. 14, the cylinder material 140 which is communicated to the through portion 132 is coupled to a lower portion of the pressure bearing plate 130.

In this case, in similar to the first embodiment, the curved portion 114 including the saw-teeth 115 is formed at the first inclined side 111 of the side plate 110, and the obstacle protrusions 134 engaged with the saw-teeth 115 is formed at the lower portion of the pressure bearing plate 130.

An auxiliary pressure bearing plate, 148 having the same curvature as the pressure bearing plate 130 is coupled to a lower end of the cylinder material 140, and the supporting materials 150 supporting the auxiliary pressure bearing plate 148 are installed to the inner surfaces of the both side plates 110.

At this time, the upper surface of the supporting material 150 has the same curvature as the curved portion 114 of the first inclined side 111.

The invention claimed is:

1. An earth anchor bracket supported by a girder coupled to a side surface of an earth wall to fix a free length of an anchor body inserted into a boring hole formed at the earth wall according to an earth anchor method, the earth anchor bracket comprising:

two side plates, each including a curved portion including saw-teeth and facing each other;

a coupling material coupling and fixing the two side plates; and a pressure bearing means supported by the two side plates and including obstacle protrusions engaged with the saw-teeth of the two side plates and a through portion withdrawing the free length of the anchor body.

2. The bracket according to claim 1, wherein the pressure bearing means includes:

a cylinder material including the through portion, wherein a lower end of the cylinder material is put between the two side plates; and rack portions outside the cylinder material and placed on the curved portions of the two side plates, wherein the rack portions include the obstacle protrusions engaged with the saw-teeth at lower portions of the rack portions.

3. The bracket according to claim 2, wherein a supporting material supporting the lower end of the cylinder material is coupled to the inner surfaces of the side plates, wherein an upper surface of the supporting material has the same curvature as the curved portion.

4. The bracket according to claim 3, wherein an auxiliary supporting material is installed to couple a lower portion of the supporting material to the inner surfaces of the side plates to increase pressure resisting ability.

5. The bracket according to claim 3, wherein hook portions are formed at the lower end of the cylinder material to hang the cylinder material on the supporting material coupled to the inner surfaces of the side plates.

6. The bracket according to claim 1, wherein the pressure bearing means includes:

a pressure bearing plate including a through portion and placed on the curved portions of the two side plates, wherein the obstacle protrusions are formed at both ends of the pressure bearing plate;

a cylinder material coupled to a lower portion of the pressure bearing plate and communicated with the through portion;

an auxiliary pressure bearing plate coupled to side of a lower end of the cylinder material; and a supporting material coupled to inner surfaces of the two side plates to support both ends of the auxiliary pressure bearing plate, wherein an upper surface of the supporting material has the same curvature as the curved portion.

7. The bracket according to claim 1, further comprising a reinforcing material including a first plate coupled to an outside surface of the side plate and a second plate bent vertically from an upper end of the first plate, wherein the upper ends of the first plate and the second plate have the same curvature as the curved portion of the side plate.

8. The bracket according to claim 1, wherein first and second base plates are spaced apart from each other and coupled to lower ends of the two side plates to distribute tension force of the anchor body to the girder; the two side plates include a plurality of coupling holes arranged in a length direction; a fixing means including at least one coupling hole is coupled to an upper surface of the first or second base plate; an interval between the first and second base plates is adjusted by selecting the coupling hole of the fixing material and the plurality of coupling holes of the side plates and joining the selected coupling holes using a bolt; and a hook end is formed at one end of the first or second base plate to hang on the girder.

9. The bracket according to claim 8, wherein the hook end is formed by bending the one end of the first or second base plate, and the bent portion is curved.

10. The bracket according to claim 9, wherein a reinforcing portion putting around the bent portion is formed at one end portion of the fixing material.

11. The bracket according to claim 2, further comprising a reinforcing material including a first plate coupled to an outside surface of the side plate and a second plate bent vertically from an upper end of the first plate, wherein the upper ends of the first plate and the second plate have the same curvature as the curved portion of the side plate.

12. The bracket according to claim 3, further comprising a reinforcing material including a first plate coupled to an outside surface of the side plate and a second plate bent vertically from an upper end of the first plate, wherein the upper ends of the first plate and the second plate have the same curvature as the curved portion of the side plate.

13. The bracket according to claim 4, further comprising a reinforcing material including a first plate coupled to an outside surface of the side plate and a second plate bent vertically from an upper end of the first plate, wherein the upper ends of the first plate and the second plate have the same curvature as the curved portion of the side plate.

14. The bracket according to claim 5, further comprising a reinforcing material including a first plate coupled to an outside surface of the side plate and a second plate bent vertically from an upper end of the first plate, wherein the upper ends of the first plate and the second plate have the same curvature as the curved portion of the side plate.

15. The bracket according to claim 6, further comprising a reinforcing material including a first plate coupled to an outside surface of the side plate and a second plate bent vertically from an upper end of the first plate, wherein the upper ends of the first plate and the second plate have the same curvature as the curved portion of the side plate.

* * * * *